US009844961B1

(12) United States Patent
Mantell et al.

(10) Patent No.: US 9,844,961 B1
(45) Date of Patent: Dec. 19, 2017

(54) SYSTEM AND METHOD FOR ANALYSIS OF LOW-CONTRAST INK TEST PATTERNS IN INKJET PRINTERS

(71) Applicant: Xerox Corporation, Norwalk, CT (US)

(72) Inventors: David A. Mantell, Rochester, NY (US); Patricia J. Donaldson, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/336,444

(22) Filed: Oct. 27, 2016

(51) Int. Cl.
*B41J 29/393* (2006.01)
*B41J 2/01* (2006.01)

(52) U.S. Cl.
CPC ..... *B41J 29/393* (2013.01); *B41J 2/01* (2013.01)

(58) Field of Classification Search
CPC ..... B41J 29/393; B41J 2/01
See application file for complete search history.

(56) References Cited

U.S. PATENT DOCUMENTS 5,343,231 A 8/1994 Suzuki
5,451,990 A 9/1995 Sorenson et al.
5,600,350 A 2/1997 Cobbs et al.
5,796,414 A 8/1998 Sievert et al.
6,076,915 A 6/2000 Gast et al.
6,089,693 A 7/2000 Drake et al.
6,196,652 B1 3/2001 Subirada et al.
6,275,600 B1 8/2001 Banker et al.
6,300,968 B1 10/2001 Kerxhalli et al.
6,310,637 B1 * 10/2001 Shimada ..... B41J 19/145 15/37
6,334,720 B1 1/2002 Kato et al.
6,377,758 B1 4/2002 Ou Yang et al.
6,467,867 B1 10/2002 Worthington et al.
6,494,558 B1 12/2002 Doval et al.
6,554,390 B2 4/2003 Arquilevich et al.
6,637,853 B1 10/2003 Ahne et al.
6,847,465 B1 1/2005 Wetchler et al.
6,883,892 B2 4/2005 Sievert et al.
6,942,313 B2 9/2005 Kanda
6,993,275 B2 1/2006 Mitsuya et al.
7,073,883 B2 7/2006 Billow
7,118,188 B2 10/2006 Vilanova et al.
7,254,254 B2 8/2007 Ueda et al.
7,309,118 B2 12/2007 Mizes et al.
(Continued)

OTHER PUBLICATIONS physicsinsights.org; Some Simple Facts about Blackbody Radiation; Aug. 6, 2009; 18 Pages; www.physicsinsights.org/blackbodies-1.html.

*Primary Examiner* — Sharon A Polk
(74) *Attorney, Agent, or Firm* — Maginot Moore & Beck LLP

(57) ABSTRACT

A method of operating a printer analyzes a printed test pattern in a low-contrast printing configuration. The method includes forming a printed test pattern having a plurality of rows of negative marks on an image receiving member, each negative mark in the plurality of rows of negative marks being surrounded by ink from at least a portion of the plurality of inkjets. The method further includes generating scanned image data of the test pattern and identifying a plurality of locations in the cross-process direction for the negative marks in at least one row of negative marks in the scanned image data of the test pattern.

17 Claims, 4 Drawing Sheets

(56) References Cited

U.S. PATENT DOCUMENTS

| | | | | |
|---|---|---|---|---|
| 7,380,897 | B2 | 6/2008 | Anderson et al. | |
| 7,390,073 | B2 | 6/2008 | Bailey et al. | |
| 7,391,525 | B2 | 6/2008 | Chapman et al. | |
| 7,478,894 | B2 | 1/2009 | Kim et al. | |
| 7,515,305 | B2 | 4/2009 | Mizes | |
| 7,549,721 | B2 | 6/2009 | Nakano et al. | |
| 7,552,986 | B2 | 6/2009 | Mizes et al. | |
| 7,607,752 | B2 | 10/2009 | Childers et al. | |
| 7,630,653 | B2 | 12/2009 | Bonino | |
| 7,637,586 | B2 | 12/2009 | Yun | |
| 7,686,298 | B2 | 3/2010 | Fioravanti et al. | |
| 8,636,331 | B2 | 1/2014 | Sugahara et al. | |
| 8,662,625 | B2 | 3/2014 | Donaldson | |
| 8,814,342 | B2 | 8/2014 | Usuda et al. | |
| 8,939,536 | B2 | 1/2015 | Smith | |
| 2002/0135629 | A1 | 9/2002 | Sarmast et al. | |
| 2003/0231350 | A1 | 12/2003 | Yamagishi | |
| 2004/0160468 | A1 | 8/2004 | Kim et al. | |
| 2005/0099447 | A1 | 5/2005 | Hsu et al. | |
| 2005/0264596 | A1* | 12/2005 | Little | B41J 25/005 347/19 |
| 2009/0003729 | A1 | 1/2009 | Metcalfe et al. | |
| 2009/0322849 | A1 | 12/2009 | Calamita et al. | |
| 2010/0013882 | A1 | 1/2010 | Mizes et al. | |
| 2010/0053248 | A1 | 3/2010 | Akatsuka | |
| 2010/0060682 | A1 | 3/2010 | Akatsuka | |
| 2010/0066780 | A1 | 3/2010 | Akatsuka | |
| 2011/0242187 | A1 | 10/2011 | Mongeon et al. | |
| 2012/0194588 | A1 | 8/2012 | Kasai | |
| 2012/0206531 | A1* | 8/2012 | Mizes | G06K 15/027 347/19 |
| 2014/0292870 | A1 | 10/2014 | Kondo et al. | |
| 2015/0109361 | A1 | 4/2015 | Watanabe | |
| 2015/0375498 | A1 | 12/2015 | Horikawa et al. | |

* cited by examiner

SYSTEM AND METHOD FOR ANALYSIS OF LOW-CONTRAST INK TEST PATTERNS IN INKJET PRINTERS

TECHNICAL FIELD

This disclosure is directed to inkjet printers and, more particularly, to systems and methods of printing test patterns and analyzing scanned image data of the test patterns in inkjet printers.

BACKGROUND

Inkjet printers form printed images using one or more printheads that include arrays of inkjet ejectors. A controller in the printer operates the ejectors to form printed images that often include both text and graphics and may be formed using one or more ink colors. Some printer embodiments employ multiple printheads, each of which includes hundreds or thousands of ejectors. Multiple printheads form different portions of a printed image and, in multicolor printer configurations, different printheads emit different ink colors to form multicolor printed images.

During operation, some printers form printed test patterns that include predetermined arrangements of printed marks on an image receiving member, such as a print medium or an indirect image receiving member such as a rotating drum or endless belt. An optical sensor generates a two-dimensional set of scanned image data of the printed test pattern that a processor or other automated control device analyzes to identify the positions of inkjets and corresponding printheads in the print zone. In some instances, a printed test pattern does not include printed marks from an inoperable inkjet. As used herein, the term "inoperable inkjet" refers to an inkjet that either fails to eject any ink drops, only ejects ink drops intermittently, or ejects ink drops onto an incorrect location of the image receiving member. The processor identifies the positions of printheads to align and register the printheads to ensure that the inkjets in the printheads are in a predetermined position to form printed images with properly aligned ink drops. Additionally, the processor identifies inoperable inkjets for printhead maintenance operations that return the inkjets to operational order or that perform compensation processes for identified and deactivated inoperable inkjets during a print job.

While conventional printed test patterns and image analysis are effective for high-contrast printed test patterns, such as black or colored ink marks that are formed on a white paper substrate or metallic surface of an indirect image receiving member, some printing setups that use low-contrast inks and image receiving members cannot employ the prior art test pattern analysis techniques effectively. For example, in a printer that ejects white ink onto an optically transparent member, the scanned image data of conventional printed test patterns may not include sufficient contrast between the printed marks and the underlying background of the print medium to enable effective automated identification of the printed marks in the scanned image data. More generally, low-contrast printing configurations refer to combinations of ink colors, including optically transparent inks, and image receiving surface colors for which a printer produces scanned image data with comparatively small differences between the numeric values of image data pixels for the printed marks in the printed test pattern and the numeric pixel values of the scanned image receiving member. The prior art printed test pattern analysis techniques are generally less effective in the automated identification of the locations of printed marks in a low-contrast printing configuration. Consequently, improved systems and methods for the generation and analysis of printed test patterns that are formed using low-contrast ink and substrate combinations would be beneficial.

SUMMARY

In one embodiment, a method analyzes test patterns made with a low-contrast ink and image receiving member surface combination. The method includes forming, with a plurality of inkjets in one printhead in a plurality of printheads in a print zone, at least a portion of a printed test pattern including a plurality of rows of negative marks on an image receiving member, each negative mark in the plurality of rows of negative marks being surrounded by ink from at least a portion of the plurality of inkjets, each row of negative marks being arranged along a cross-process direction of the image receiving member and the plurality of rows of negative marks being arranged along a process direction of the image receiving member, and generating, with an optical sensor, scanned image data of the printed test pattern. The method further includes identifying, with a controller operatively connected to the optical sensor, a plurality of locations in the cross-process direction for the negative marks in at least one row of negative marks in the printed test pattern with reference to the scanned image data of the printed test pattern, and identifying, with the controller, a location of the one printhead in the cross-process direction in relation to a reference printhead in the plurality of printheads with reference to the plurality of locations in the cross-process direction for the negative marks in the at least one row.

In another embodiment, an inkjet printer is configured to analyze test patterns of made with a low-contrast ink and image receiving member surface combination. The inkjet printer includes a print zone including a plurality of printheads, each printhead including a plurality of inkjets, each inkjet being configured to eject drops of ink onto an image receiving member that moves through the print zone in a process direction, an optical sensor configured to generate scanned image data of the image receiving member, and a controller operatively connected to the plurality of inkjets in each of the plurality of printheads, the optical sensor, and a memory. The controller is configured to operate the plurality of inkjets in one printhead in the plurality of printheads to form at least a portion of a printed test pattern including a plurality of rows of negative marks on the image receiving member, each negative mark in the plurality of rows of negative marks being surrounded by ink from at least a portion of the plurality of inkjets, each row of negative marks being arranged along a cross-process direction of the image receiving member and the plurality of rows of negative marks being arranged along the process direction of the image receiving member, generate scanned image data of the printed test pattern with the optical sensor, identify a plurality of locations in the cross-process direction for the negative marks in at least one row of negative marks in the printed test pattern with reference to the scanned image data of the printed test pattern, and identify a location of the one printhead in the cross-process direction in relation to a reference printhead in the plurality of printheads with reference to the plurality of locations in the cross-process direction for the negative marks in the at least one row.

In another embodiment, a method analyzes test patterns made with a low-contrast ink and image receiving member surface combination. The method includes forming, with a plurality of inkjets in one printhead in a plurality of printheads in a print zone, at least a portion of a printed test pattern including a plurality of rows of negative marks on an image receiving member, each negative mark in the plurality of rows of negative marks being surrounded by ink from at least a portion of the plurality of inkjets with a predetermined subset of the plurality of inkjets being deactivated in a location corresponding to each negative mark in each row of the plurality of rows of negative marks, each row of negative marks being arranged along a cross-process direction of the image receiving member and the plurality of rows of negative marks being arranged along a process direction of the image receiving member, each row of negative marks being formed with a predetermined cross-process direction distance between each inkjet in the predetermined subset of inkjets for each row, and generating, with an optical sensor, scanned image data of the printed test pattern. The method further includes identifying, with a controller operatively connected to the optical sensor, a plurality of locations in the cross-process direction for the negative marks in at least one row of negative marks in the printed test pattern with reference to the scanned image data of the printed test pattern, identifying, with the controller, a first negative mark at a first location in the cross-process direction of a first row in the plurality of rows of negative marks that does not correspond to any inkjet in the predetermined subset of inkjets corresponding to the first row, and identifying, with the controller, an inoperable inkjet in the plurality of inkjets with reference to the first location in the cross-process direction of the first negative mark.

BRIEF DESCRIPTION OF THE DRAWINGS

The foregoing aspects and other features of an apparatus or printer that identifies negative marks in a test pattern in a low-contrast printing configuration are explained in the following description, taken in connection with the accompanying drawings.

DETAILED DESCRIPTION

Figure 1:
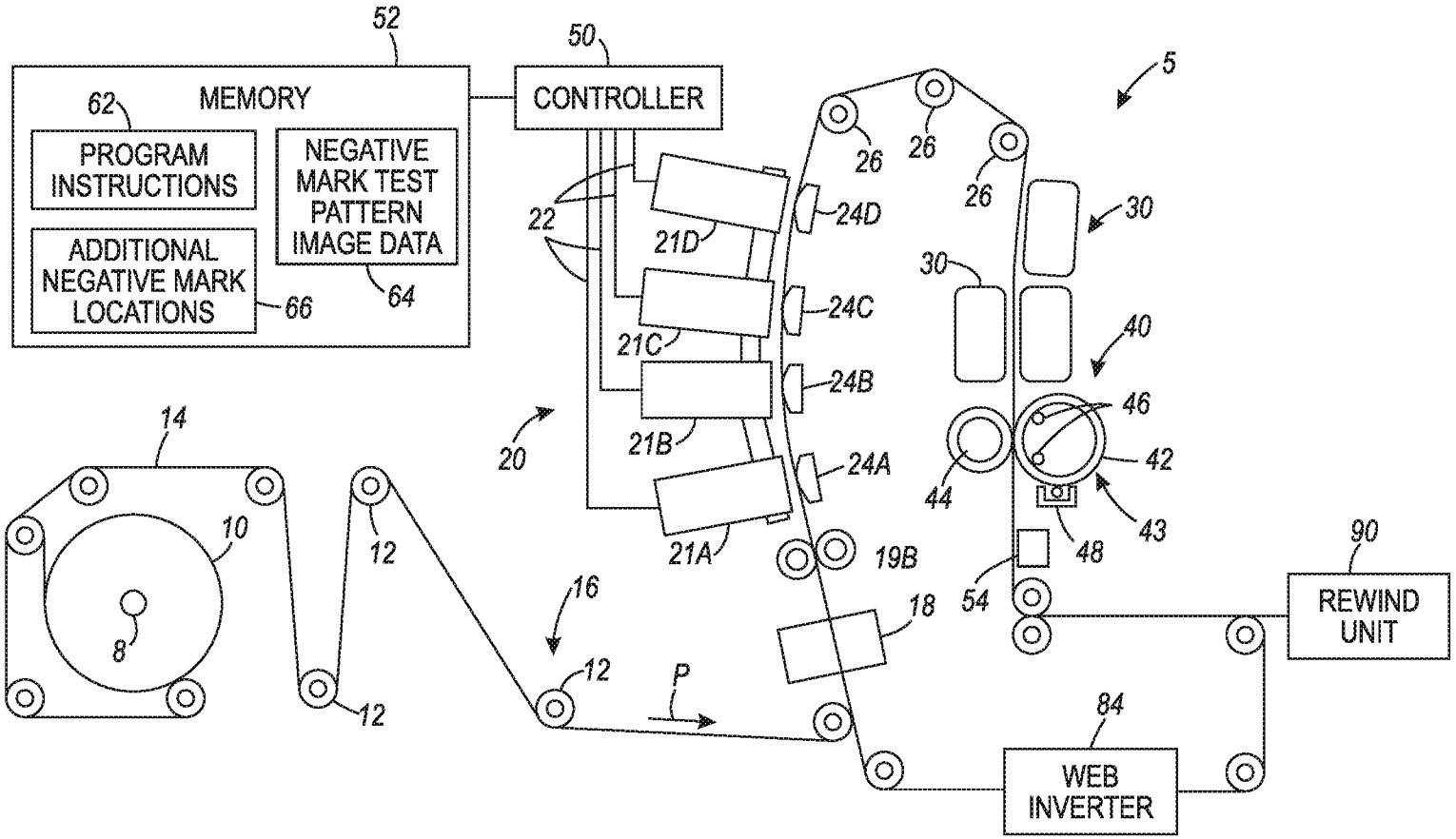
FIG. 1 is a schematic diagram of an inkjet printer that is configured to form printed test patterns with negative marks that are surrounded by printed ink in the test pattern to enable test pattern analysis in a low-contrast printing configuration.

For a general understanding of the environment for the device disclosed herein as well as the details for the device, reference is made to the drawings. In the drawings, like reference numerals designate like elements.

As used herein, the word "printer" encompasses any apparatus that produces images with colorants on media, such as digital copiers, bookmaking machines, facsimile machines, multi-function machines, and the like. As used herein, the term "process direction" refers to a direction of movement of an image receiving member through the printer. For example, a continuous media web formed from paper, plastic, or another suitable print medium substrate material pulled from a roll moves in the process direction along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. In an indirect inkjet printer, a rotating drum or endless belt also moves in the process direction to receive drops of ink from a plurality of inkjets in one or more printheads in the print zone of the printer. As used herein, the term "cross-process" direction refers to an axis that is perpendicular to the process direction along a surface of the image receiving member. Examples of image receiving members include print media such as paper and optically transparent polymer substrates or indirect image receiving members including rotating drums, endless belts, and platen.

As used herein, the term "low-contrast ink" refers to an ink with an optical density distribution in scanned image data that has significant overlap with the distribution of the image receiving member, such as a print medium or intermediate roller or belt, that receives the printed ink. The overlap in the distributions of optical density data for the low-contrast ink and the underlying image receiving member reduces the effectiveness of traditional image processing techniques since the scanned image data for the ink and the image receiving member may be difficult to distinguish. As used herein, the term "high-contrast ink" refers to an ink with an optical density distribution in scanned image data that does not have significant overlap with the distribution of the image receiving member. Thus, the configuration of both the ink color and the underlying image receiving member influence whether the ink is considered low-contrast or high-contrast. For example, white or optically transparent ink on a white paper print medium is an example of print configuration that uses a low-contrast ink since the distribution of the image response values for the ink includes substantial overlap with the underlying image receiving member. Additionally, black ink on a black or other dark colored print medium is another example of a low-contrast ink configuration. However, black ink on white paper or white ink on black paper are examples of printer configurations with high-contrast ink.

As used herein, the term "negative mark" refers to a region of a printed test pattern in which a selected inkjet does not eject any ink drops while all of the neighboring inkjets eject ink drops to form a "hole" or blank region of an underlying image receiving member that is surrounded by ink. In some embodiments, the negative mark corresponds to a physical region that would be occupied by a predetermined number of ink drops arranged adjacent to one another along the process direction if the inkjet had been activated. Such negative marks are also referred to as "negative dashes" or more simply "dashes" herein. The negative mark differs from a positive mark in that a positive mark refers to a particular arrangement of printed ink drops from an inkjet that a printer identifies in scanned image data as corresponding to a particular inkjet. Prior art test patterns are formed from patterns of positive marks. While the test patterns described herein fill two-dimensional regions of an image receiving member with filled ink regions that surround rows of negative marks, some of the test patterns described herein may omit the positive marks of conventional test patterns. Instead, the printer forms the regions around the negative marks with a continuously filled region of ink that does not enable analysis of the scanned image data to identify specific inkjets from specific positive marks. Instead, the embodiments described herein use scanned image data to identify the locations of the inkjets and printheads, and optionally to identify inoperable inkjets based on the locations of the negative marks in the scanned image data.

FIG. 1 is a schematic diagram of an inkjet printer 5. FIG. 1 is a simplified schematic view of the direct-to-sheet, continuous-media, inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. For simplex printing, the printer includes the web roller 8, media conditioner 16, print zone or printing station 20, and rewind unit 90. For duplex operations, the web inverter 84 is used to flip the web to present a second side of the media to the printing station 20 before being taken up by the rewind unit 90. In the simplex operation, the media source 10 has a width that substantially covers the width of the rollers 12 and 26 over which the media travels through the printer. In duplex operation, the media source has a width that is approximately one-half of the width of the rollers. Thus, the web can travel over about one-half of the length of the rollers in the printing station 20 before being flipped by the inverter 84 and laterally displaced by a distance that enables the web to travel over the other half of the length of the rollers in the printing station 20. The rewind unit 90 is configured to wind the web onto a roller for removal from the printer 5 and subsequent processing.

In FIG. 1, the printer 5 performs simplex or duplex printing operations on the media web 14. In many printer configurations, the media web 14 is an elongated roll of white paper. However, in some low-contrast printing configurations the material in the media web 14 is an optically transparent polymer substrate. The flexible polymer substrate can form, for example, transparent sheets with printed images for use in signs, presentations, product packaging, and many other uses.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place ink directly (i.e., without use of an intermediate or offset member) onto the moving media. The controller 50 is operatively connected to the color units 21A-21D through control lines 22. Each of the color units 21A-21D includes a plurality of printheads positioned in a staggered arrangement in the cross-process direction over the media web 14. In the printer 5, each color unit includes printheads that eject drops of a single color, although other printer configurations eject multiple colors from a single set of printheads. In the printer 5, at least the color unit 21A is configured to eject drops of a low-contrast ink onto the media web 14, where examples of the low-contrast ink include white ink, yellow ink, optically transparent ink, or another ink color that produces a low optical contrast on the surface of the media web 14. The remaining color units 21B-21D eject other colors of ink and may be configured to eject ink colors with higher contrast levels such as cyan, magenta, and black inks. The controller 50 of the printer receives velocity data from encoders mounted proximately to rollers positioned on either side of the portion of the path opposite the four printheads to compute the position of the media web 14 as the media web 14 moves in the process direction through the print zone 20. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer.

In the illustrative embodiment of FIG. 1, the printer 5 uses four different colors of an ultraviolet (UV) curable phase change ink, which refers to inks that remain in a liquid or a gelatinous state until being ejected onto a print medium and being exposed to a UV light source that cures the ink into a durable printed image on the print medium. One example of a low-contrast UV curable ink printer configuration includes a white UV curable ink that the printer ejects onto a transparent plastic substrate. Alternative printer embodiments use a single color of ink or a different number of ink colors. In printer embodiments that form low-contrast ink patterns on paper substrates, such as white paper, the low-contrast ink may be an optically transparent phase change ink that the printheads in the printer eject onto a surface of the white paper substrate. The phase change ink melting temperature can be any temperature that is capable of melting solid phase change ink into liquid or molten form. In one embodiment, the phase change ink melting temperature is approximately 70° C. to 140° C.

Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 1, each backing member includes a heater that emits thermal energy to heat the media to a predetermined temperature that, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also influence the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and the substrate at rollers 26, this "mid-heater" can add or remove heat from the substrate and/or ink. The mid-heater 30 brings the ink placed on the media to a temperature suitable for desired properties when the ink on the media is sent through the fixing assembly 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 1, the fixing assembly includes a "spreader" 43, that applies a predetermined pressure, and in some implementations, heat, to the media. The function of the spreader 43 is to take what are essentially droplets, strings of droplets, or lines of ink on web 14 and smear the droplets on the surface of the print medium by an application of pressure and, in some systems, heat, so that spaces between adjacent drops are filled and image solids become uniform. In addition to spreading the ink, the spreader 43 also improves image permanence by increasing ink layer cohesion and/or increasing the ink-web adhesion. The spreader 43 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone 20. Such a non-contact fixing assembly uses any suitable type of heater to heat the media to a desired temperature, such as a radiant heater, UV heating lamps, and the like. In a UV ink printer embodiment, the fixing assembly 40 includes UV light sources that direct UV radiation at the ink to cross-link and fix the ink to the surface of the media web.

In one practical embodiment, the roller temperature in spreader 43 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side.

The fixing assembly 40 also includes a cleaning/oiling station 48 associated with image-side roller 42. The station 48 cleans and/or applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 43 can be combined into a single unit, with their respective functions occurring relative to the same portion of media simultaneously. In another embodiment, the media is maintained at a high temperature during the printing operation to enable the spreader 43 to spread the ink while the ink is in a liquid or semi-liquid state.

Following passage through the fixing assembly 40, the printed media can be wound onto a roller for removal from the system (simplex printing) or directed to the web inverter 84 for inversion and displacement to another section of the rollers for a second pass by the printheads, mid-heaters, and spreader. The duplex printed material is subsequently wound onto a roller for removal from the system by rewind unit 90. Alternatively, additional processing stations receive the print medium and perform tasks such as cutting, binding, collating, and/or stapling the media or the like.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The memory 52 includes volatile data storage devices such as random access memory (RAM) and non-volatile data storage devices including magnetic and optical disks or solid state storage devices. The processors, their memories, and interface circuitry configure the controllers and/or print engine to perform the test pattern formation and image data analysis processes described herein. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

As described in more detail below, the controller 50 executes stored program instructions 62 in the memory 52 to form a printed test pattern that includes a plurality of rows of negative marks on the media web 14 with reference to predetermined negative mark test pattern image data 64. The controller 50 operates the printheads and corresponding inkjets in at least the color unit 21A to form the printed test pattern with negative marks on the media web 14. The controller 50 optionally operates the remaining color units 21B-21D to print conventional test patterns if these color units are configured to print a high-contrast ink onto the media web 14. In another embodiment, the controller 50 fills a region of the media web 14 with the low-contrast ink from the color unit 21A and subsequently prints test patterns using the high-contrast ink colors from the color units 21B-21D on the filled region. As described below, the controller 50 forms printed test patterns based on the test pattern image data 64 to form rows of negative marks that are arranged in a predetermined pattern with a selected subset of inkjets in at least one printhead forming the negative marks in each row. The controller 50 generates scanned image data of the test pattern with negative marks using the optical sensor 54. The printer 5 uses the scanned image data to identify rows of negative marks in the test pattern to identify the locations of inkjets and printheads in the print zone for printhead registration and to identify inoperable inkjets.

Printhead registration refers to an alignment between the positions and orientations of one or more printheads in the print zone to form printed patterns with inkjets in positions that deposit ink on the expected locations of the media web. Properly registered printheads in the cross-process direction form printed images without noticeable gaps in the image where printheads are positioned too far apart or regions that receive too much ink from two or more overlapping sets of inkjets in two printheads. Additionally, the printer 5 registers sets of printheads in different color units that eject different ink colors to ensure that multiple colors of ink are deposited in the correct locations for color reproduction in printed images. In the printer 5, the color units 21A-21D include actuators to reposition printheads along the cross-process direction axis CP to register the printheads after the controller 50 has identified the locations of the printheads based on the scanned image data of printed test patterns, including the negative test patters disclosed herein. In some instances, the controller 50 registers the printheads that eject the low-contrast inks using the negative test patterns with different sets of printheads in color units that eject high contrast ink colors using conventional printed test patterns, and the printer 5 performs different sets of image processing operations for the different types of test patterns. In addition to registration in the cross-process direction, the printer 5 optionally adjusts the timing of the generation of electrical firing signals that operate inkjets in the different printheads to register the printheads along the process direction axis P. In some printer configurations, the printer 5 also uses the locations of the negative marks in a test pattern to identify and correct rotational skew of the printheads about a "z" axis that extends perpendicularly from the surface of the media web.

The printer 5 includes an optical sensor 54 that is configured to generate image data corresponding to the media web 14 and printed test patterns formed on the media web 14. The optical sensor is configured to generate signals indicative of reflectance levels of the media, ink, or backer roll opposite the sensor to enable detection of, for example, the presence and/or location of ink drops jetted onto the receiving member by the inkjets of the printhead assembly. The optical sensor 54 includes an array of optical detectors mounted to a bar or other longitudinal structure that extends across the width of an imaging area on the image receiving member. The optical sensor 54 also includes a fluorescent tube or an array of lights that project light that is diffuse in the cross-process direction onto the media web 14 to illuminate the surface of the media web 14 under the detectors and any printed marks and negative marks formed thereon.

In one embodiment, the imaging area is approximately twenty inches wide in the cross-process direction and the inkjets in the printheads form test patterns with negative marks and other printed images at a resolution of 600 dots per inch (DPI) in the cross-process direction. In this embodiment, over 12,000 optical detectors are arrayed in a single row along the bar to generate a single scanline of image data corresponding to a line across the image receiving member. The optical detectors are configured in association with one or more light sources that direct light towards the surface of the image receiving member. The optical detectors receive the light generated by the light sources after the light is reflected from the image receiving member, such as the media web 14. The magnitude of the electrical signal generated by an optical detector corresponds to the amount of light reflected into the detector from the surface of the media web 14, including bare portions of the media web surface and portions that carry printed ink patterns. The magnitudes of the electrical signals generated by the optical detectors are converted to digital values by an appropriate analog/digital converter.

FIG. 1 depicts the printer 5 as a direct to media inkjet printer that ejects drops of ink to form printed images directly on a print medium. An indirect printer embodiment includes an indirect image receiving member, such as a drum or endless belt, which receives the ink drops from the printheads in the printer and subsequently transfers the latent ink image to a print medium. The techniques for printing test patterns and performing image analysis of test patterns for low-contrast ink and image receiving member configurations that are described herein are equally suited to both direct and indirect printers.

Figure 2:
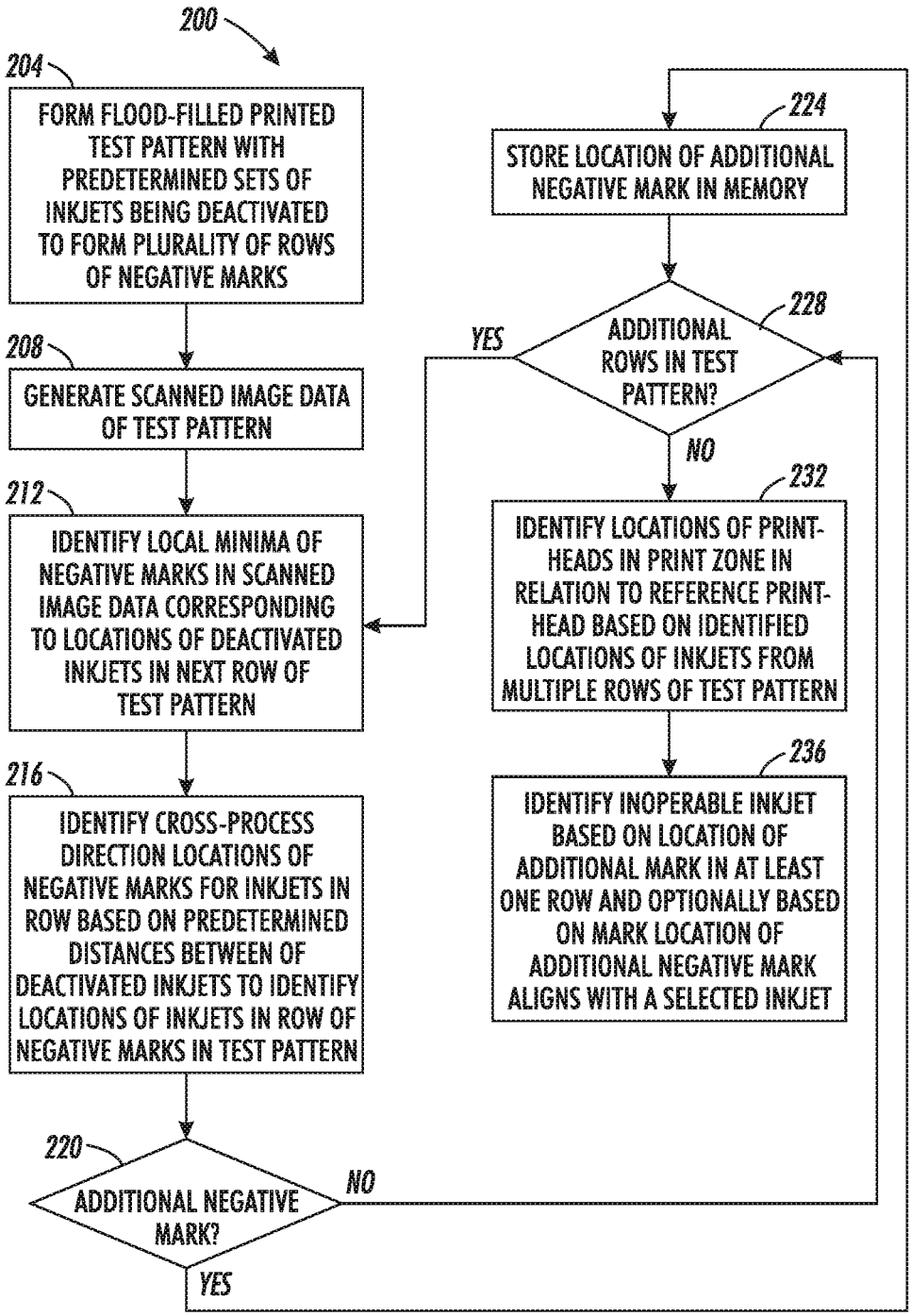
FIG. 2 is a block diagram of a process for formation and analysis of a test pattern including rows of negative marks that are formed in a printed test pattern that is otherwise filled with ink.

FIG. 2 is a block diagram of process 200 for generating and analyzing printed test patterns in an inkjet printer. In the discussion below, a reference to the process 200 performing a function or action refers to the operation of a processor or controller that executes stored instructions to perform the function or action with other components in the printer. Process 200 is described in conjunction with the printer 5 of FIG. 1 for illustrative purposes.

Process 200 begins as the controller 50 in the printer 5 retrieves the test pattern data 64 from the memory 52 and forms the printed test pattern including a plurality of rows of negative marks on an image receiving surface, such as the media web 14 in the printer 5 (block 204). Using white ink on an optically transparent media web 14 as an example, the controller 50 operates the inkjets in at least one of the printheads of the color unit 21A to form a printed test pattern that includes a plurality of rows of negative marks on an image receiving member. In the printer 5, the media web 14 is the media web and is formed from an optically transparent polymer substrate. The combination of white ink and the optically transparent substrate has a low-contrast in scanned image data. Each row of negative marks in the test pattern is arranged along the cross-process direction of the image receiving member and the plurality of rows of negative marks are arranged along the process direction of the image receiving member.

During the process 200, the controller 50 operates the plurality of inkjets to form each row of negative marks in the test pattern with a predetermined subset of the plurality of inkjets not ejecting drops of ink. The predetermined subset of the inkjets that do not eject ink drops in each row form negative marks in the row, while a remaining portion of the plurality of inkjets eject drops of the ink onto the image receiving member to fill the printed test pattern around the plurality of negative marks with the ink. The test pattern includes multiple rows of the negative marks and the test pattern image data 64 specify that different subsets of the ejectors do not operate in different sets of rows. Thus, the printed test pattern includes at least one negative mark formed by each of the inkjets in the plurality of inkjets in the at least one printhead in at least one row in the test pattern.

Figure 3:
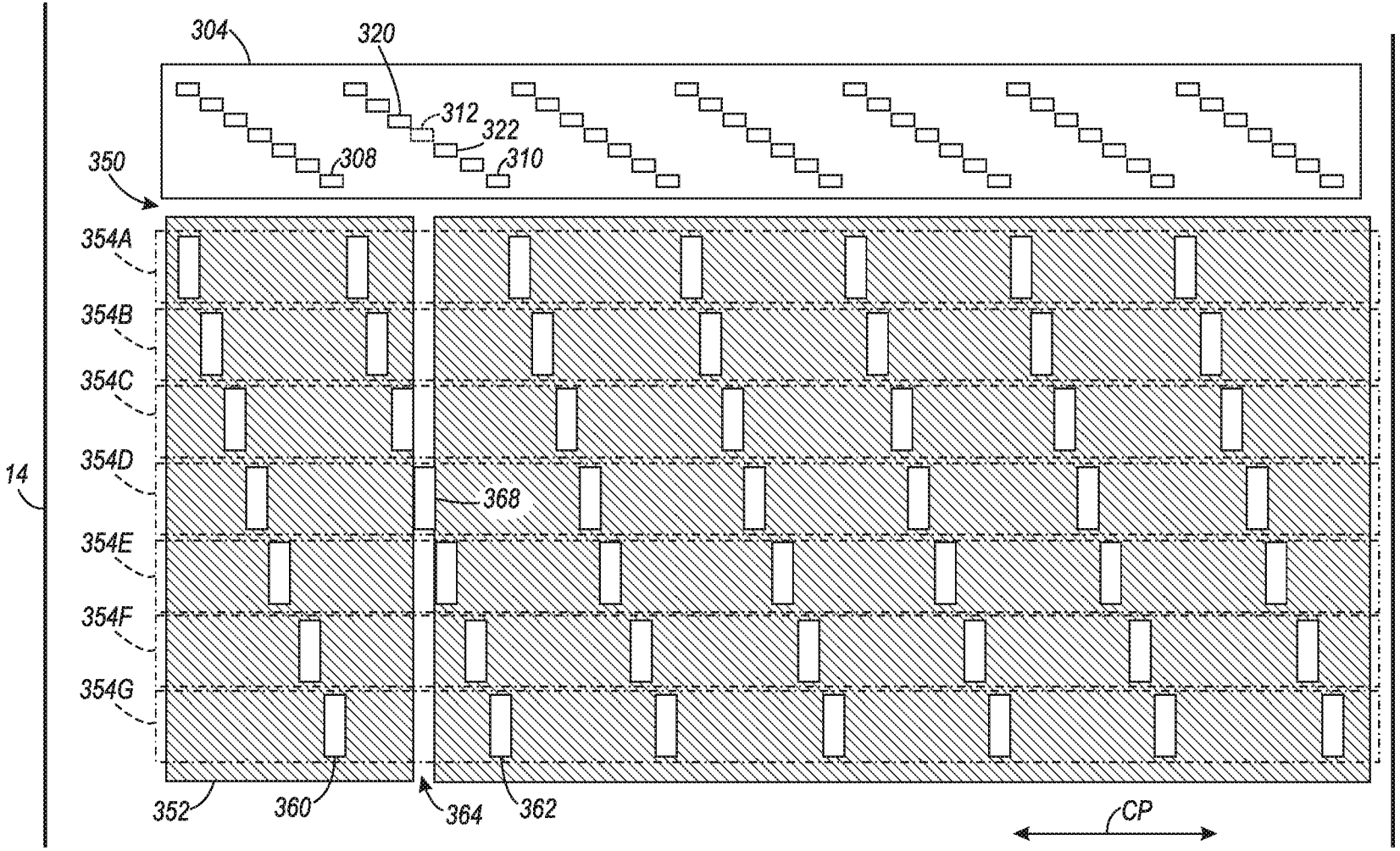
FIG. 3 is an illustrative embodiment of inkjets in a printhead in the printer of FIG. 1 and a printed test pattern that includes multiple rows of negative marks.

FIG. 3 depicts an example of a portion of a printed test pattern 350 that includes a plurality of rows of negative marks formed by a plurality of inkjets in a printhead 304 on the media web 14. The printhead 304 includes an array of inkjets, including inkjets 308, 310, and 312. In the example of FIG. 3, the inkjet 312 is an inoperable inkjet that does not eject drops of ink to form any portion of the test pattern 350. The remaining inkjets eject ink drops in response to electrical firing signals from the controller 50 based on the stored test pattern data 64. The test pattern 350 includes a filled region 352 that the inkjets in the printhead 304 and optionally other inkjets from other printheads in the printer 5 substantially fill with the low-contrast ink, such as white ink on an optically transparent polymer substrate media web 14. The test pattern 350 includes the plurality of rows of negative marks 354A-354G. Each row is formed by a predetermined subset of the inkjets in the printhead 304 that the controller 50 deactivates to ensure that the subset of inkjet do not eject drops of ink within a portion of the printed test pattern corresponding to at least one row of negative marks. The controller 50 selects different subsets of inkjets from the printhead 50 for different rows to ensure that each inkjet in the printhead 304 forms at least one negative mark in on row of negative marks in the test pattern 350.

For example, row 354G includes negative mark 360 that the controller 50 forms by not operating the inkjet 308 for a predetermined time while the remaining inkjets form the filled region around the negative mark 360. Similarly, the controller 50 prevents operation of the inkjet 310 to form the negative mark 362. The negative marks shown in FIG. 3 are negative dashes that correspond to a region that would otherwise be filled by a predetermined number of adjacent ink drops (e.g. 10 ink drops) if the corresponding inkjets were to be activated. In the illustrative example of FIG. 3, each row of negative marks 354A-354G includes a predetermined cross-process direction distance between adjacent marks in the row, which corresponds to the same predetermined cross-process direction offset between the locations of inkjets in the printhead 304 that form the negative marks in each row. In FIG. 3, the controller 50 deactivates a subset of the inkjets in the printhead 304 with a separation of six inkjets in the printhead 304 between each deactivated inkjet in the cross-process direction based on the test pattern image data 64. The predetermined cross-process direction distance between the inkjets that form each row of negative marks produces a predetermined spatial frequency of the expected locations of negative marks along the cross-process direction access.

The inoperable inkjet 312 fails to eject ink drops and produces a streak 364 that extends in the process direction through the filled region 352 of the test pattern 350. If the inoperable inkjet 312 were operational, the inkjet 312 would form the negative mark 368 as part of row 354D in the test pattern 350. Thus, the inoperable inkjet 312 actually produces a correct negative mark in the row of negative marks 354D where the inkjet 312 is part of the selected subset of inkjets that are supposed to be deactivated. However, the inoperable inkjet 312 also produces additional negative marks in one or more of the other rows 354A-354C and 354E-354G that are not part of the negative marks in the test pattern 350. As described in more detail below, the controller 50 uses the predetermined cross-process direction offset between the negative marks in the row to distinguish between the negative marks that belong to the test pattern and a streak that also has the characteristics of a negative mark but is produced by an inoperable inkjet.

FIG. 3 depicts a portion of the inkjets in a single printhead 304 that forms the test pattern 350. In the printer 5, the printhead 304 is one printhead in an array of printheads in one of the color units, such as the color unit 21D. Each color unit includes a plurality of printheads in a staggered configuration that fully covers the width of the media web 14 in the cross-process direction. Each of the color units 21A-21D includes an array of the printheads. One or more of the other printheads in the printer 5 also form a test pattern with the negative marks in a similar manner to the test pattern 350 of FIG. 3. During a registration process, the printer 5 adjusts the cross-process direction locations of printheads both within the individual color units and between different color units into alignment with one another in the cross-process direction to form multi-color printed images using high-contrast and low-contrast inks.

FIG. 3 depicts a single row of negative dashes for each selected subset of inkjets in the printhead 304 for illustrative purposes. Alternative test pattern configurations include multiple rows formed by each subset of inkjets to enable the controller 50 to identify the locations of inkjets based on multiple rows of the test pattern, which increases the accuracy via detection of groups of negative marks from each inkjet instead of a single negative mark. Furthermore, the specific arrangement of negative marks shown in FIG. 3 is just one example of a suitable arrangement of negative marks, and the process 200 is suitable for use with different arrangements of negative marks in different test patterns. Alternative test patterns include groups of negative marks that are arranged in the cross-process direction with predetermined gaps formed between each group of adjacent negative marks. Additionally, the regions of filled ink that surround the negative marks optionally include ink from other printheads in the print zone 20 of the printer 5 to enable the inkjets on the periphery of the printhead 308 in the cross-process direction to form negative marks that are fully surrounded by ink on the surface of the media web 14.

Referring again to FIG. 2, the process 200 continues as the printer 5 generates scanned image data of the printed test pattern on the image receiving member using the optical sensor 54 (block 208). The optical sensor 54 generates a series of image data scanlines where each scanline includes a linear array of pixels extending in the cross-process direction across the media web 14. The optical sensor 54 generates a series of scanlines as the media web 14 moves in the process direction P to produce the image data as a two-dimensional array of pixels. Each pixel of the scanned image data stores a reflectance value that corresponds to the level of light that is reflected from a corresponding location in the printed test pattern. In the printer 5, the optical sensor 54 includes the light source that projects light that is diffuse in the cross-process direction onto the printed test pattern. The negative marks that are surrounded by the white ink or another low-contrast ink, such as an optically transparent ink, on the print medium produce appear as gray marks, such as gray dashes, in the scanned image data. It is believed that light entering the negative marks scatters differently within and around the edges of the negative marks compared to the surrounding ink even if the contrast levels of the print medium and the ink are not substantially different. Thus, while the ink and the underlying print medium are otherwise low-contrast and traditional printed marks on the print medium generate scanned image data that are similar to the underlying print medium, the negative marks in the scanned image data have sufficient contrast for identification using the controller 50.

Process 200 continues as the controller 50 identifies the local minima of the negative marks in the scanned image data that correspond to the locations of the negative marks in the cross-process direction and of the corresponding inkjets that formed the negative marks in the cross-process direction (block 212). During process 200 the controller 50 identifies the local minima for the negative marks in at least one row of marks in the printed test patter 350 and, in the example of FIG. 2, the controller 50 identifies the local minima in each of the rows of negative marks in the printed test pattern 350. As used herein, the term "local minimum" refers to a set of image data values arranged along the cross process direction that show a decrease in reflectance values down to a minimum value followed by an increase in reflectance values. The local minimum corresponds to the change in reflectance levels between the filled portion of the printed test pattern 350, through one of the negative marks, and returning to another filled portion of the test pattern 350. Each row of negative marks includes a plurality of local minima in locations of the image data that correspond to the negative marks in the test pattern and potentially to additional streaks that are produced by inoperable inkjets.

Figure 4:
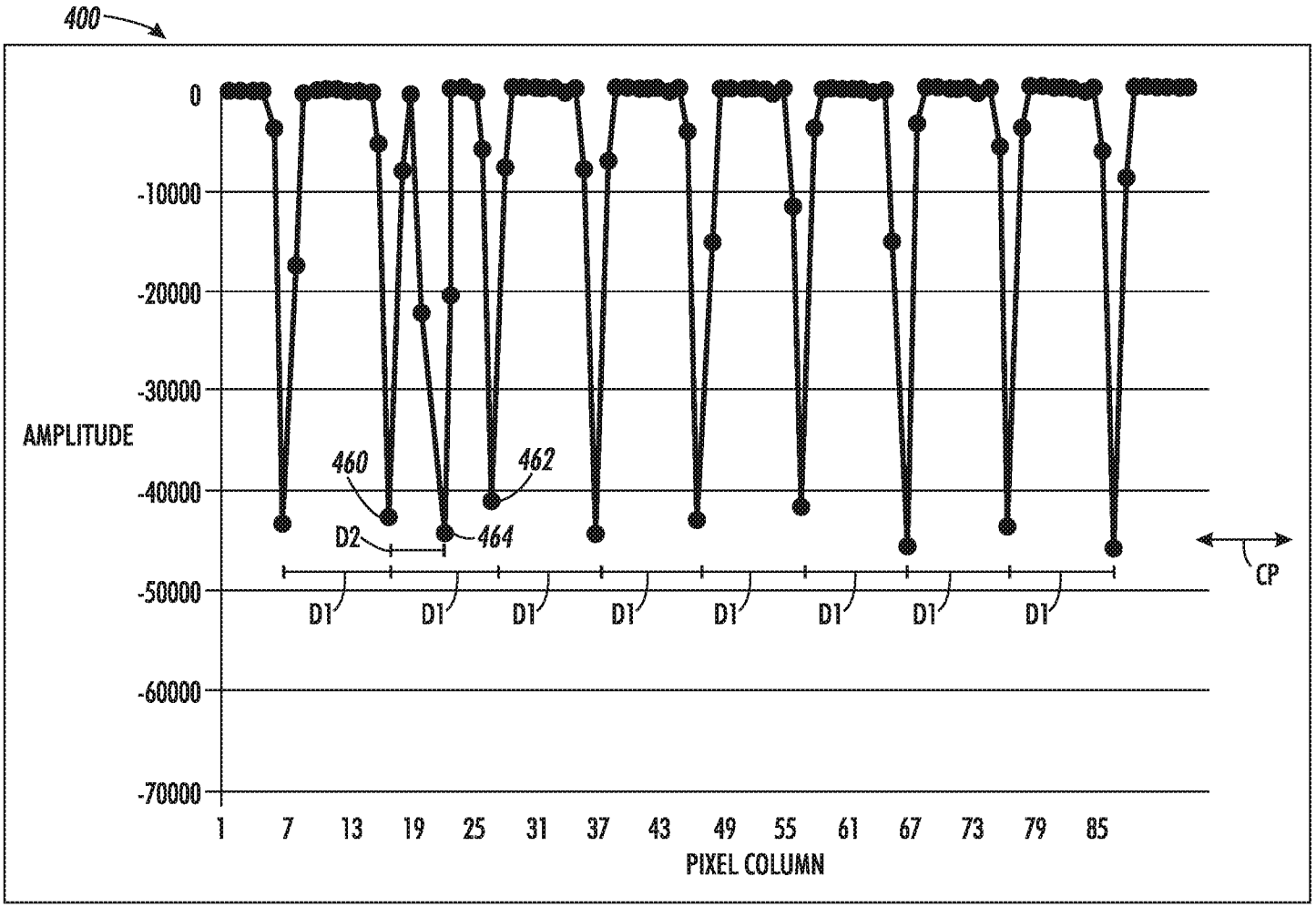
FIG. 4 is a diagram of scanned image data for a portion of one row of a printed test pattern including local minima corresponding to the locations of negative marks in a cross-process direction axis.

FIG. 4 depicts a graph of reflectance values of scanned image data 400 that includes a plurality of negative marks that form a portion of one row of a test pattern. In FIG. 4, the local minimum at pixel 460 corresponds to one negative mark in the test pattern and the local minimum at location 462 corresponds to an adjacent negative mark in the same row of the test pattern. The local minimum 464, however, corresponds to a streak in the test pattern formed by an inoperable inkjet, such as the streak 364 that the inoperable inkjet 312 forms through the test pattern 350 in FIG. 3. In some embodiments, the reflectance values depicted in FIG. 4 depict averaged reflectance values of multiple scanlines of image data in a two-dimensional sub-region of the scanned image data that corresponds to one row of the printed negative marks. The averaged image data reduce the effects of noise in the identification of local minimum where the negative marks are negative dashes that extend in the process direction through multiple scanlines of the image data. In other embodiments, the controller 50 processes individual scanlines of the image data and identifies the locations of negative marks based on local minima that occur in a series of scanlines.

In one embodiment, the controller 50 identifies individual negative marks in a row using a convolution process with a first predetermined convolution kernel that identifies individual negative marks and a second set of convolution kernels that identify multiple negative marks in a row of the printed test pattern based on the predetermined cross-process direction distance between the negative marks. To identify individual marks, the controller 50 convolves the image data with a first predetermined kernel that corresponds to the general form of the local minima in the scanned image data to identify the locations of individual negative marks in each row of negative marks. The controller 50 translates the convolution kernel across the scanned image data along the cross-process direction axis and identifies a local minimum at a cross-process direction location that produces a maximum convolution value that exceeds a predetermined threshold to reduce the effects of noise in the scanned image data. The convolution kernel corresponds not only to a single reduced reflectance value at the center of a negative mark, but also to the neighboring reflectance values that show reduced reflectance levels to improve the accuracy of detecting negative marks and distinguishing between negative marks and random noise in the image data. The controller 50 uses a single convolution kernel for a single local minimum to identify locations of all the local minima in the image data that correspond to a row of negative marks in the test pattern. In a typical set of scanned image data, most or all of the negative marks correspond to the test pattern, but one or more additional negative marks may be present due to inoperable inkjets.

As noted above, in some conditions the row of negative marks in a test pattern may include one or more additional negative marks that are not actually part of the predetermined test pattern. Process 200 continues as the controller 50 identifies the cross-process direction locations of negative marks for the subset of inkjets that form the negative marks in one row of the printed test pattern using a second set of convolution kernels. The controller 50 identifies the negative marks that belong to the printed test pattern based on the locations of the local minima and the predetermined cross-process direction distances between the subset of inkjets that form each row of negative marks in the printed test pattern (block 216). In addition to identifying the individual locations of negative marks in a row of test pattern data, the controller 50 identifies the cross-process direction locations of multiple negative marks that correspond to multiple inkjets in the printhead to identify the locations of the inkjets, and the corresponding printhead or array of printheads, in the cross-process direction. In one embodiment, the controller 50 uses a larger kernel that includes periodic functions having the periodicity of the predetermined cross-process direction distance corresponding to the spatial frequency of negative marks in the predetermined test pattern. For example, in FIG. 4 the image data include a separation of approximately 10 pixels of image data between the centers of negative dashes that are in the test pattern. The controller 50 uses at least one kernel that corresponds to the period of the negative marks in the scanned image data and identifies the locations of the printed negative marks for all or a portion of the row at a location where the convolution of the kernel produces a maximum value for all of the negative marks in the row of the test pattern.

For example, in one configuration the controller 50 convolves the scanned image data for a row of negative marks in the cross-process direction with a cosine and a sine function having a periodicity at the expected periodicity of the negative marks arranged in the cross-process direction. The controller 50 generates the squares of the individual convolutions and compares the sums of the squares to a predetermined threshold to detect the presence of multiple negative marks. The controller 50 identifies the cross-process direction location of the convolution that exceeds the threshold or reaches a maximum value at any location in the cross-process direction as the location of the predetermined set of negative marks in the row of the test pattern. The controller 50 then identifies a location of the printhead in the cross-process location based on an average location of the identified inkjets in one or more rows of the test pattern and can identify the locations of individual inkjets in the printhead. As used in this document, "convolution" refers to the summation of the product of two functions. Thus, the summation of the product of the profile function and sine function is computed and the summation of the product of the profile function and cosine function is computed. As used in this document, the terms "sum," "summing," and "summation" all refer to mathematical operations in which input data are submitted to an algorithm that includes addition.

In the example of FIG. 4, the controller 50 applies the convolution kernels with a spatial period that corresponds to the expected cross-process direction distance D1 that separates negative marks in the scanned image data of the printed test pattern. The periodic kernel enables the controller 50 to identify the locations of the negative marks that form the test pattern, such as the negative marks at locations 460 and 462 in FIG. 4. However, the convolution kernels do not match with the streak at location 464 in FIG. 4 because, even though the streak has substantially the same image data pattern as one of the negative marks, the location of the streak does not align with the other marks using the predetermined cross-process direction offset D1. Instead, the streak 464 is located at as shorter distance D2 from the negative mark 460. The controller 50 generates a convolution response for the convolution kernels centered on the negative mark 464 that is much lower than when the convolution kernels are aligned with the negative marks 460, 462, and the other negative mark locations in the test pattern. The controller 50 identifies the locations of the corresponding inkjets and printheads in the printer 5 based on the cross-process direction pixel locations of the identified negative marks that correspond to the physical locations of the inkjets and printheads in the print zone 20 of the printer 5.

FIG. 4 depicts local minima in scanned image data that correspond to the negative marks in a row of the test pattern. The illustrative example of FIG. 4 refers to a combination of ink and an image receiving member where the negative mark regions have reduced optical reflectivity and corresponding local minima in the reflectance levels of scanned image data. Of course, in another configuration of ink and image receiving member colors, the negative marks can have higher reflectivity than the filled ink regions, which produce local maxima in the reflectance values of scanned image data in the inverse of the local minima depicted in FIG. 4. However, the same techniques that are described herein for the detection of local minima in scanned image data are equally applicable to detecting negative marks that correspond to local maxima in the scanned image data. Thus, as used herein, the terms "local minima" or "local minimum" should also be understood to include the inverse terms "local maxima" or "local maximum", respectively, for configurations in which the negative mark corresponds to a region of increased reflectance to light instead of a decreased reflectance to light.

Process 200 continues as the controller 50 identifies if the row includes one or more additional negative marks that are not part of the predetermined negative marks in the test pattern (block 220). As described above, the printer 5 forms the printed test patterns with selected subsets of inkjets that the controller 50 operates to form each row of negative marks with a predetermined cross-process direction distance between each inkjet in the predetermined subset of inkjets for each row. The predetermined cross-process direction offset between the inkjets that form negative marks in each row enables the controller 50 to distinguish between the negative marks that are formed as part of the test pattern and other gaps in the filled area of the printed test pattern that form due to an inoperable inkjet. The predetermined cross-process direction distance that separates the negative marks in the test pattern corresponds to an expected spatial frequency of the negative marks in each row of the test pattern. As described above, the controller 50 applies a convolution kernel that detects individual negative marks to identify all the negative marks in a single row.

Another streak through a row that corresponds to an inoperable inkjet forms a local minimum that is similar to the negative marks for the predetermined subset of inkjets that form negative marks in the row. However, the location of the streak in the cross-process direction does not correspond to the expected cross-process direction distances between adjacent negative marks for any of the selected subset of inkjets that form negative marks in the row. The controller 50 uses the predetermined special frequency of the row to identify the streak as being an additional negative mark that is not part of the predetermined test pattern. The controller 50 identifies any local minima that are not part of the predetermined row of negative marks in the test pattern as additional negative marks. In the event of detecting any additional negative marks that do not belong to the predetermined test pattern, the controller 50 stores the cross-process direction locations of the additional negative marks in the memory 52 with the additional negative mark location data 66 in association with the row in the test pattern (block 224).

The process 200 continues through the processing described above in conjunction with blocks 212-224 for any additional rows of negative marks in the scanned image data of the printed test pattern (block 228). After processing the scanned image data for all of the rows in the printed test pattern, the controller 50 identifies the location of the at least one printhead that formed the negative test pattern in relation to the reference printhead in the print zone 20. The controller 50 identifies the location of the at least one printhead based on the plurality of locations in the process direction for the negative marks in one or more rows of the negative test pattern (block 232). As used herein, the identification of the location of a printhead refers to the identification of the location of the printhead in one or more of the cross-process direction, the process direction, and a measurement of rotation the printhead about a "z" axis that is perpendicular to the surface of the image receiving member. In the printer 5, a single reference printhead in one of the color units 21A-21D acts as a reference location for identification of the relative cross-process direction and process direction locations of all the other printheads in the color units, including the printhead in the process 200 that forms printed test patterns with negative marks. In some printer configurations, the printheads in the color units that eject high-contrast inks form prior-art printed test patterns that are not described in further detail herein, while the printheads in the color units that eject low-contrast inks form the printed test patterns with negative marks during the process 200.

For example, the controller 50 identifies the location of at least one printhead in the print zone 20 in the cross-process direction CP and the process direction P in relation to the location of the reference printhead in one of the color units 21A-21D based on the locations of the negative marks in the scanned image data of test pattern that correspond to locations of the inkjets in the printhead. Since the inkjets in each printhead are located in fixed positions within the printhead body, the controller 50 identifies the location of the printhead based on the identified locations of inkjets within the printhead along the cross-process direction and process direction axes. The process of identifying the locations of the different printheads in the print zone based on the locations of negative marks in the printed test pattern is part of a larger registration process to align the printheads in relation to each other based on the reference printhead. The controller 50 optionally performs further registration processes to align multiple printheads from one or more of the color units 21A-21D based on the identified locations of each printhead in the print zone 20.

Using FIG. 3 as an example, the controller 50 identifies the location of the printhead 304 along the cross-process direction axis CP based on the identified locations of the inkjets in the printhead that the controller 50 identifies with reference to the locations of the negative marks in the test pattern 350. In one embodiment the controller 50 identifies a center location of the printhead 304 based on an average of the cross-process direction locations of all the inkjets. Different embodiments identify the location of the printhead 304 based on, for example, the locations of the cross-process direction locations of the left-most and right-most inkjets in the printhead 304 or other characteristics of the identified locations of the inkjets. The cross-process direction location information for one or more printheads enables the controller 50 to operate actuators to adjust the relative positions of the printheads in a color unit, such as the color unit 21A that ejects white ink in the printer 5, to register the multiple printheads. The additional procedures for printhead registration that occur after the completion of the process 200 are otherwise known to the art and are not described in further detail herein.

During process 200, the controller 50 also identifies an inoperable inkjet that may be present in at least one printhead based on the previously identified cross-process location of one or more negative marks that do not belong to at least one row of negative marks in the predetermined test pattern (block 236). Referring to FIG. 3 and FIG. 4 by way of example, the inoperable inkjet 312 does not eject drops of the white ink to form any part of the printed test pattern 350, and the streak 364 corresponds to the regions of the media web 14 that do not receive ink from the inkjet 312. The streak 364 does not correspond to the predetermined distance that separates the neighboring negative marks in any of the rows 354A and 354C-354G with the exception of row 354D, which is the row of the test pattern 350 that is supposed to include a negative mark from the inoperable inkjet 312. Using row 354G as an example, the negative marks 360 and 362 both belong to the test pattern 350, but the inoperable inkjet 312 forms an additional negative mark that is not part of the test pattern.

As described above, the controller 50 stores the cross-process direction location data 66 for the additional negative marks in the memory 52. During process 200, the controller 50 identifies inoperable inkjets in the printhead 304 based on the stored cross-process direction location data for an additional negative mark that does not belong to the predetermined printed test patter in at least one row of the test pattern. In some embodiments, the controller 50 only identifies the inoperable inkjet in response to identification of the additional negative mark at the same cross-process direction location or within a comparatively narrow range of cross-process direction locations in two or more test pattern rows. For example, in the test pattern 350 of FIG. 3, the controller 50 stores the cross-process direction location of the negative marks corresponding to the streak 364 in the additional negative mark data 66 of the memory for each of the rows 354A-354C and 354E-354G. Since the same additional negative mark occurs at the same cross-process direction location in multiple rows of the scanned image data, the controller 50 identifies the inoperable inkjet with greater accuracy since random image noise is unlikely to produce a negative mark at the same cross-process location in multiple rows of the scanned image data of the printed test pattern.

In some embodiments, the controller 50 identifies the inoperable inkjet based on the cross-process direction locations of the additional negative marks that occur in one or more rows of the scanned image data. For example, in FIG. 3 the streak 364 has a cross-process direction location that is located between the previously identified cross-process direction locations of the inkjets 320 and 322. The controller 50 identifies that the inkjet 312 is inoperable based on the cross-process direction locations of the additional negative marks in the streak 364 relative to the cross-process direction locations of the inkjets 320 and 322 in conjunction with the predetermined arrangement of inkjets in the printhead 304.

In another embodiment, the controller 50 identifies the inoperable inkjet using the negative mark in at least one row of the printed test pattern that has the same cross-process location as the additional negative mark that is identified in one or more rows of the test pattern but that actually belongs to the negative marks in the test pattern. Again referring to FIG. 3, the inoperable inkjet 312 belongs to the subset of inkjets that form the negative marks in the row 354D in the printed test pattern 350, which is shown by the dashed location 368 that would correspond to a negative mark produced by an operable inkjet. The cross-process direction location of the negative mark at location 368 is substantially the same as the cross-process direction location of the streak 364 and of all the additional negative marks that the controller 50 identifies in the remaining rows of the printed test pattern 350. The controller 50 also identifies the negative mark 368 as belonging to the test pattern only in the row 354D where the negative mark 368 is located in the expected cross-process direction location that aligns with the inkjet 312. To identify the inoperable inkjet during process 200, the controller 50 identifies the row 354D that does not include the additional negative mark since the negative mark 368 is part of the test pattern in row 354D. The controller 50 identifies that the inkjet 312 that forms the negative mark 368 is the inoperable inkjet since the cross-process direction locations of the additional negative marks in the remaining rows have the same or similar cross-process direction locations in the scanned image data.

As described above, the streak 364 extends through the entire region of the printed negative test pattern including regions that lie outside of any rows of negative marks. In another embodiment of the process 200, the controller 50 identifies the negative mark at a cross-process direction location of the negative test pattern that lies outside of any rows of negative marks. The controller 50 identifies the inoperable inkjet that corresponds to the cross-process direction location of the streak 364 to with reference to at least one other cross-process direction of another mark in the plurality of rows of marks that is within a predetermined distance of the negative mark for the streak 364 in the cross-process direction. For example, in FIG. 3 controller 50 identifies the inoperable inkjet for the streak 364 based on the cross-process direction locations of the negative marks in rows 354B-354C that are proximate to the streak 364 on the left and the negative marks in rows 354E-354F that are proximate to the streak 364 on the right. In some rows 354C and 354E the proximate negative mark are immediate neighbors and contribute to a larger negative mark, which can be distinguished from a single negative mark. For optical detection systems with limited resolution even nearby negative marks such as 354B and 354F may be too close to the negative mark from the inoperable inkjet to distinguish the precise location of each negative mark and therefore would typically left out of analysis of the subsequent analysis of printhead alignment. For distinguishable negative marks the negative marks of the neighboring inkjets are within a predetermined distance of the negative streak corresponding to the cross-process direction distance of two nearby inkjets in the printhead 304.

After identifying the inoperable inkjet, the controller 50 deactivates the inoperable inkjet until a printhead maintenance process returns the inoperable inkjet to an operable state. The printer 5 optionally performs inoperable inkjet compensation processes with neighboring inkjets around the inoperable inkjet using techniques that are known to the art and that are not described in further detail herein.

The printer 5 and the process 200 enable the formation and analysis of scanned image data for test patterns for ink and image receiving member combinations that have a low-contrast. While traditional printed test patterns do not enable efficient analysis of scanned image data to distinguish between printed marks and the underlying print medium or indirect image receiving member, the foregoing test patterns and image processing techniques enable identification of the locations of inkjets and printheads and detection of inoperable inkjets even in low-contrast printing configurations. While the process 200 is described above in conjunction with a single printhead for illustrative purposes, the printer 5 performs the process 200 for each printhead in a color unit, such as the color unit 21D, to identify the locations of printheads and to identify inoperable inkjets for multiple printheads in the print zone.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of test pattern analysis in a printer comprising:

forming, with a plurality of inkjets in one printhead in a plurality of printheads in a print zone, at least a portion of a printed test pattern including a plurality of rows of negative marks on an image receiving member, each negative mark in the plurality of rows of negative marks being surrounded by ink from at least a portion of the plurality of inkjets, each row of negative marks being arranged along a cross-process direction of the image receiving member and the plurality of rows of negative marks being arranged along a process direction of the image receiving member;

generating, with an optical sensor, scanned image data of the printed test pattern;

identifying, with a controller operatively connected to the optical sensor, a plurality of locations in the cross-process direction for the negative marks in at least one row of negative marks in the printed test pattern with reference to the scanned image data of the printed test pattern;

identifying, with the controller, a location of the one printhead in the cross-process direction in relation to a reference printhead in the plurality of printheads with reference to the plurality of locations in the cross-process direction for the negative marks in the at least one row;

identifying, with the controller, a cross-process direction location of a first negative mark in scanned image data of a region of the image receiving member covered by the ink outside of any row of negative marks in the plurality of rows of negative marks; and identifying, with the controller, an inoperable inkjet in the plurality of inkjets with reference to the cross-process direction of the first negative mark and at least one other cross-process direction of another mark in the plurality of rows of marks that is within a predetermined distance of the first negative mark in the cross-process direction.

2. The method of claim 1, the identifying of the plurality of locations in the cross-process direction for the negative marks further comprising: identifying, with the controller, a plurality of local minima in the scanned image data, each local minimum in the plurality of local minima corresponding to a location in the cross-process direction of one negative mark in the at least one row of negative marks.

3. The method of claim 2, the forming of the printed test pattern further comprising:

operating the plurality of inkjets to form each row of negative marks in the plurality of rows of negative marks with a predetermined subset of the plurality of inkjets not ejecting drops of an ink to form each row of negative marks with a remaining portion of the plurality of inkjets ejecting drops of the ink onto the image receiving member to fill the printed test pattern around the plurality of negative marks with the ink, the plurality of rows of negative marks being formed with each inkjet in the plurality of inkjets being in the predetermined subset of inkjets for at least one row of the plurality of rows to form a negative mark in the at least one row.

4. The method of claim 3 further comprising:

operating the plurality of inkjets to form each row of negative marks with a predetermined cross-process direction distance between each inkjet in the predetermined subset of inkjets for each row;

identifying, with the controller, the negative marks in each row of negative marks corresponding to the predetermined subset of inkjets with reference to the local minimum for each negative mark in the scanned image data and with reference to the predetermined cross-process direction distance between each inkjet;

identifying, with the controller, a first negative mark at a first location in the cross-process direction of a first row in the plurality of rows of negative marks that does not correspond to any inkjet in the predetermined subset of inkjets corresponding to the first row; and identifying, with the controller, an inoperable inkjet in the plurality of inkjets with reference to the first location in the cross-process direction of the first negative mark.

5. The method of claim 4, the identification of the inoperable inkjet further comprising:

identifying, with the controller, a second negative mark in the first location in the cross-process direction of a second row in the plurality of rows of negative marks that corresponds to one inkjet in the predetermined subset of inkjets for the second row; and identifying, with the controller, the one inkjet in the predetermined subset of inkjets for the second row as being the inoperable inkjet in response to identification of the first negative mark in the first row at the first process direction location.

6. The method of claim 1, the formation of the test pattern on the image receiving member further comprising:

forming the test pattern on an optically transparent polymer substrate.

7. The method of claim 1, the formation of the test pattern on the image receiving member further comprising:

surrounding each negative mark in the plurality of rows of negative marks with a white ink.

8. The method of claim 1, the formation of the test pattern on the image receiving member further comprising:

surrounding each negative mark in the plurality of rows of negative marks with an optically transparent ink.

9. An inkjet printer comprising:

a print zone including a plurality of printheads, each printhead including a plurality of inkjets, each inkjet being configured to eject drops of ink onto an image receiving member that moves through the print zone in a process direction;

an optical sensor configured to generate scanned image data of the image receiving member; and a controller operatively connected to the plurality of inkjets in each of the plurality of printheads, the optical sensor, and a memory, the controller being configured to:

operate the plurality of inkjets in one printhead in the plurality of printheads to form at least a portion of a printed test pattern including a plurality of rows of negative marks on the image receiving member, each negative mark in the plurality of rows of negative marks being surrounded by ink from at least a portion of the plurality of inkjets, each row of negative marks being arranged along a cross-process direction of the image receiving member and the plurality of rows of negative marks being arranged along the process direction of the image receiving member and the plurality of inkjets being operated to form each row of negative marks in the plurality of rows of negative marks with a predetermined subset of the plurality of inkjets not ejecting drops of an ink to form each row of negative marks with a remaining portion of the plurality of inkjets ejecting drops of the ink onto the image receiving member to fill the printed test pattern around the plurality of negative marks with the ink, the plurality of rows of negative marks being formed with each inkjet in the plurality of inkjets being in the predetermined subset of inkjets for at least one row of the plurality of rows to form a negative mark in the at least one row;

generate scanned image data of the printed test pattern with the optical sensor;

identify a plurality of locations in the cross-process direction for the negative marks in at least one row of negative marks in the printed test pattern with reference to the scanned image data of the printed test pattern, the plurality of locations identified in the cross-process direction for the negative marks being based on a plurality of local minima in the scanned image data, each local minimum in the plurality of local minima corresponding to a location in the cross-process direction of one negative mark in the at least one row of negative marks; and identify a location of the one printhead in the cross-process direction in relation to a reference printhead in the plurality of printheads with reference to the plurality of locations in the cross-process direction for the negative marks in the at least one row.

10. The inkjet printer of claim 9, the controller being further configured to:

operate the plurality of inkjets to form each row of negative marks with a predetermined cross-process direction distance between each inkjet in the predetermined subset of inkjets for each row;

identify the negative marks in each row of negative marks corresponding to the predetermined subset of inkjets with reference to the local minimum for each negative mark in the scanned image data and with reference to the predetermined cross-process direction distance between each inkjet;

identify a first negative mark at a first location in the cross-process direction of a first row in the plurality of rows of negative marks that does not correspond to any inkjet in the predetermined subset of inkjets corresponding to the first row; and identify an inoperable inkjet in the plurality of inkjets with reference to the first location in the cross-process direction of the first negative mark.

11. The inkjet printer of claim 10, the controller being further configured to:

identify a second negative mark in the first location in the cross-process direction of a second row in the plurality of rows of negative marks that corresponds to one inkjet in the predetermined subset of inkjets for the second row; and identify the one inkjet in the predetermined subset of inkjets for the second row as being the inoperable inkjet in response to identification of the first negative mark in the first row at the first process direction location.

12. The inkjet printer of claim 10, the controller being further configured to:

identify a second negative mark at the first location in the cross-process direction of a second row in the plurality of rows of negative marks that does not correspond to any inkjet in the predetermined subset of inkjets corresponding to the second row; and identify the inoperable inkjet in the plurality of inkjets with reference to the first location in the cross-process direction of the first negative mark and the first location in the cross-process direction of the second negative mark.

13. The inkjet printer of claim 12, the controller being further configured to:

identify a third negative mark in the first location in the cross-process direction of a third row in the plurality of rows of negative marks that corresponds to one inkjet in the predetermined subset of inkjets for the third row; and identify the one inkjet in the predetermined subset of inkjets for the third row as being the inoperable inkjet in response to identification of the first negative mark in the first row at the first process direction location and the second negative mark in the second row at the first process direction location.

14. The inkjet printer of claim 9 wherein the image receiving member is an optically transparent polymer substrate.

15. An inkjet printer comprising:

a print zone including a plurality of printheads, each printhead including a plurality of inkjets, each inkjet being configured to eject drops of ink onto an image receiving member that moves through the print zone in a process direction;

an optical sensor configured to generate scanned image data of the image receiving member; and a controller operatively connected to the plurality of inkjets in each of the plurality of printheads, the optical sensor, and a memory, the controller being configured to:

operate the plurality of inkjets in one printhead in the plurality of printheads to form at least a portion of a printed test pattern including a plurality of rows of negative marks on the image receiving member, each negative mark in the plurality of rows of negative marks being surrounded by a white ink from at least a portion of the plurality of inkjets, each row of negative marks being arranged along a cross-process direction of the image receiving member and the plurality of rows of negative marks being arranged along the process direction of the image receiving member;

generate scanned image data of the printed test pattern with the optical sensor;

identify a plurality of locations in the cross-process direction for the negative marks in at least one row of negative marks in the printed test pattern with reference to the scanned image data of the printed test pattern; and identify a location of the one printhead in the cross-process direction in relation to a reference printhead in the plurality of printheads with reference to the plurality of locations in the cross-process direction for the negative marks in the at least one row.

16. An inkjet printer comprising:

a print zone including a plurality of printheads, each printhead including a plurality of inkjets, each inkjet being configured to eject drops of ink onto an image receiving member that moves through the print zone in a process direction;

an optical sensor configured to generate scanned image data of the image receiving member; and a controller operatively connected to the plurality of inkjets in each of the plurality of printheads, the optical sensor, and a memory, the controller being configured to:

operate the plurality of inkjets in one printhead in the plurality of printheads to form at least a portion of a printed test pattern including a plurality of rows of negative marks on the image receiving member, each negative mark in the plurality of rows of negative marks being surrounded by an optically transparent ink from at least a portion of the plurality of inkjets, each row of negative marks being arranged along a cross-process direction of the image receiving member and the plurality of rows of negative marks being arranged along the process direction of the image receiving member;

generate scanned image data of the printed test pattern with the optical sensor;

identify a plurality of locations in the cross-process direction for the negative marks in at least one row of negative marks in the printed test pattern with reference to the scanned image data of the printed test pattern; and identify a location of the one printhead in the cross-process direction in relation to a reference printhead in the plurality of printheads with reference to the plurality of locations in the cross-process direction for the negative marks in the at least one row.

17. A method of test pattern analysis in a printer comprising:

forming, with a plurality of inkjets in one printhead in a plurality of printheads in a print zone, at least a portion of a printed test pattern including a plurality of rows of negative marks on an image receiving member, each negative mark in the plurality of rows of negative marks being surrounded by ink from at least a portion of the plurality of inkjets with a predetermined subset of the plurality of inkjets being deactivated in a location corresponding to each negative mark in each row of the plurality of rows of negative marks, each row of negative marks being arranged along a cross-process direction of the image receiving member and the plurality of rows of negative marks being arranged along a process direction of the image receiving member, each row of negative marks being formed with a predetermined cross-process direction distance between each inkjet in the predetermined subset of inkjets for each row;

generating, with an optical sensor, scanned image data of the printed test pattern;

identifying, with a controller operatively connected to the optical sensor, a plurality of locations in the cross-process direction for the negative marks in at least one row of negative marks in the printed test pattern with reference to the scanned image data of the printed test pattern;

identifying, with the controller, a first negative mark at a first location in the cross-process direction of a first row in the plurality of rows of negative marks that does not correspond to any inkjet in the predetermined subset of inkjets corresponding to the first row; and identifying, with the controller, an inoperable inkjet in the plurality of inkjets with reference to the first location in the cross-process direction of the first negative mark.

* * * * *